US012103743B2

(12) United States Patent
Mero

(10) Patent No.: US 12,103,743 B2
(45) Date of Patent: Oct. 1, 2024

(54) PRODUCT PACKAGE AND METHOD OF MANUFACTURING THE SAME AS WELL AS PACKAGE BLANK

(71) Applicant: JOSPAK OY, Forssa (FI)

(72) Inventor: Taneli Mero, Forssa (FI)

(73) Assignee: JOSPAK OY, Forssa (FI)

( * ) Notice: Subject to any disclaimer, the term of this patent is extended or adjusted under 35 U.S.C. 154(b) by 446 days.

(21) Appl. No.: 17/312,882

(22) PCT Filed: Dec. 11, 2019

(86) PCT No.: PCT/FI2019/050884
§ 371 (c)(1),
(2) Date: Jun. 10, 2021

(87) PCT Pub. No.: WO2020/120840
PCT Pub. Date: Jun. 18, 2020

(65) Prior Publication Data

US 2022/0055789 A1 Feb. 24, 2022

(30) Foreign Application Priority Data

Dec. 14, 2018 (FI) ..... 20186088

(51) Int. Cl.

| | |
|---|---|
| ***B65D 5/20*** | (2006.01) |
| ***B65D 5/00*** | (2006.01) |
| ***B65D 5/60*** | (2006.01) |
| ***B65D 77/20*** | (2006.01) |

(52) U.S. Cl.
CPC ..... *B65D 5/20* (2013.01); *B65D 5/0015* (2013.01); *B65D 5/603* (2013.01); *B65D 77/2024* (2013.01)

(58) Field of Classification Search
CPC ..... B65D 5/20; B65D 5/0015; B65D 5/603; B65D 77/2024; B65D 5/0005; B65D 2577/2025; B65D 2577/205; B65D 81/2015; B65D 5/209; B65D 5/56; B65D 21/0233; B65D 5/2038
USPC ..... 229/407; 206/505, 518, 557, 519, 114; 426/113
See application file for complete search history.

(56) References Cited

U.S. PATENT DOCUMENTS 5,533,623 A * 7/1996 Fischer ..... B65D 5/0015 206/505
11,434,038 B2 * 9/2022 Tye ..... B65D 5/2047

FOREIGN PATENT DOCUMENTS

ES 2697705 B2 * 2/2020 ..... B29C 43/203
JP 2006290368 A * 10/2006

* cited by examiner

*Primary Examiner* — Christopher R Demeree
(74) *Attorney, Agent, or Firm* — Ziegler IP Law Group LLC.

(57) ABSTRACT

A product package includes a receiving space (1*a*), a covering film (7), an inner lining (6) and a body part (2) created out of a single blank. The body part (2) includes walls (2*a*, 2*b*, 2*c*, 8), a bottom (3) and a rim portion (4) as well as a plurality of slots (5) for shaping the receiving space (1*a*). The rim portion (4) of the body part (2) is a continuous, seamless and planar portion formed out of the same said blank and interconnecting the walls (2*a*, 2*b*, 2*c*, 8) of the body part (2).

12 Claims, 7 Drawing Sheets

PRODUCT PACKAGE AND METHOD OF MANUFACTURING THE SAME AS WELL AS PACKAGE BLANK

FIELD OF THE INVENTION

The invention relates to a product package, such as a foodstuff package, principally made of recyclable fiber material. The invention further relates to a method of manufacturing the product package. The invention relates as well as to a package blank for manufacturing, inter alia, the product package. A preferable material option for the product package can be corrugated paperboard, cardboard, or any other appropriate recyclable fiber material.

BACKGROUND OF THE INVENTION

It is known that there are different kinds of foodstuff packages available, packaged with, for example, cold cuts, other meat and fish products, cheeses, or ready meals which can be heated in a microwave oven or the like, for example. In a skin-package, a content is packaged in a vacuum between a skin-film and a package body. The body part is coated with a foodstuff foil, which hereafter also can be referred to as an inner lining. The flexible skin-film gives the product a natural and selling appearance by enhancing the distinctiveness of the product through the package. The flexible foil follows closely the surface of the product inside the package and creates a natural and visual impression of the freshness, colors and genuineness of the product. Currently, a major part of these packages are entirely made of non-recyclable plastic, and, instead of printing, product and brand information labels adhered thereto. This is an environmental problem. The body part of the package is made of suitable plastic or lined, on the inside, with a separate foodstuff foil. The package is given a suitable shape to allow a desired amount of food to be packaged therein. Besides, the design includes a horizontal circumferential flange extending around the top edge of the entire package and intended as an attachment face and a seaming base for a package lid used to tightly close the package by heat-sealing once the package has been filled and the food contained therein has been cooked, if needed. The food contained in the package must often be cooked before it can be passed on to be sold as a ready meal. This involves the problem that the cooking takes place at a high temperature, in an oven, for example, which all package box plastics cannot withstand, with the result that special expensive plastics must be used for the boxes.

Foodstuff packages made of cardboard or the like, for example, and lined, on the inside, with a separate foodstuff foil, are also known. A solution like this is disclosed in EP 2 441 696. The top edge of the cardboard-based foodstuff package described in this patent specification is provided, similarly to the above-described plastic package, with a substantially horizontal, laterally extending planar circumferential flange for attaching a lid. Besides, the package is lined, on the inside, with a foodstuff foil, the foil also extending over the circumferential flange. This solution suffers, inter alia, from the problem that the shape of the package only is supported by the inner lining, i.e. the foodstuff foil, which, in combination with the discontinuous rim portion results in that the package does not have torsional stiffness and in that the seams of the circumferential flange provided at the top edge are not tight and even. The above increases the risk that unevennesses and gaps remain between the foodstuff foil pulled over the circumferential flange and the lid heat-sealed thereto, causing the foodstuff package to lose its gas-tightness and, thereby, let air into the foodstuff package. If the sealing does not succeed reliably and the package is not tight enough, the package may have to be wrapped in separate plastic, which, in turn, increases the material costs and the need of space, the package is not being as tidy in appearance as without such extra wrapping.

Foodstuff packages are industrially machine-filled with a foodstuff. If a package stack cannot be effortlessly handled by a machine, this easily causes production problems. A very common problem is that the uppermost package of the stack does not come off while the machine is transferring it to a conveyor belt. To solve this problem, foodstuff packages are provided with different kinds of brackets to make machine-operated unstacking easier by maintaining appropriate spaces (gaps) between packages stacked in a nested way.

Sometimes, a paperboard or cardboard package is folded, out of a planar package blank, into a suitable shape. To minimize the costs, the aim is that the entire package blank is created from a single blank but often the corners of a foodstuff package, for example, are folded in such a way that there are more than one superimposed material layers in the walls or especially in the corners, at the fold. This drawback increases the manufacturing costs of the foodstuff package by causing material loss.

Product package boxes are filled automatically and each single product package box is picked out of a product package stack by a machine. Any product package boxes jammed and attached against each other disturb the filling process, which, in turn, extends the product-batch manufacturing time and decreases the efficiency of the production process.

BRIEF SUMMARY OF INVENTION

This invention aims at replacing the airtight tray solutions currently in use, such as the all-plastic skin-trays, with a solution containing less plastic, and to replace the skin-bases having a direct-laminated cardboard-plastic structure with smaller skin-trays. Biodegradable plastic products, such as PLA plastic, made of natural materials, for example, can also be used as the plastic films. This invention also aims at eliminating the above-mentioned drawbacks and to provide an inexpensive, stackable, non-jamming and machine-operable, sturdy as well as space- and cost-effective stackable product package. It also aims at providing a product package with reliable lid attachment, resulting in that the product package is tight when closed by a lid. Likewise, it aims at providing a package blank easily foldable into a product package providing air- and watertightness. Because the blank has effective utilization of area, separability of plastic and cardboard, as well a vast printing area, the solution contributes to recyclability, brand visibility, shelving and transportation efficiency.

The product package according to the invention is characterized in what is set forth in the characterizing part of claim 1. Accordingly, the method of manufacturing said product package according to the invention is characterized in what is set forth in the characterizing part of claim 12, while the product package blank for creating said product package according to the invention is characterized in what is set forth in the characterizing part of claim 11. Other embodiments of the invention are characterized in what is set forth in the rest of the claims.

The product package according to the invention comprises a receiving space, a covering film, an inner lining and a body part created from a single blank, the body part comprising walls, a bottom and a rim portion as well as a plurality of slots for shaping the receiving space. The rim portion of the body part is a continuous, seamless and planar portion made from the same said blank and interconnecting the walls of the body portion.

In the method of manufacturing the product package according to the invention, the product package according to the invention comprises a receiving space, a covering film, an inner lining and a body part created from a single blank, the body part comprising walls, a bottom and a rim portion, and, in the method, a plurality of slots are made in the body part, for shaping the receiving space. The rim portion, which continuous, seamless and planar, is created, from the same said blank, on the body part.

The product package blank according to the invention comprises a sheet-like structure made of recyclable fiber material and having a bottom portion (bottom portions), a wall portion (wall portions) and a rim portion for a bottom, walls, bracket members and a rim portion of a product package created from the product package blank. The rim portion of the product package blank is a continuous, seamless and planar entity adapted to act, substantially as such, as a rim portion of the finished product package.

In the solution according to the invention, the bottom portion (bottom portions), wall portions and the rim portion of the body part are created out of the product blank and put together, by means of the inner lining, from a two-dimensioned product blank into a three-dimensioned product package.

An advantage of the solution according to invention is, inter alia, that the product package principally consists of recyclable material, thus almost entirely overcoming the environmental problems related to plastic packages. This sustainable development solution allows the user to easily separate the plastic layers from the body material as separate recyclable waste. Another advantage is that the planar rim portion of the product package, coated by the inner lining, is substantially seamless and even all over, allowing the product package to be securely and reliably closed by the lid and to become completely tight. This results in the advantage that no extra wrapping plastic is needed and the foodstuff can be packed in a skin-package or in a packaging gas to increase the shelf-life of the foodstuff.

Another advantage are savings in the manufacturing material and costs, resulting from that the product package according to the invention is folded out of a single cardboard or paperboard blank and from that the product package does not have sections with superimposed material. In addition, the outer edges of the material blank constitute the outer edges of the rim portion of the product package and the internal section is entirely used for creating the product package, thus eliminating any loss of the blank material.

Another advantage is that the product package is made to be easily stackable in a nested way, without allowing jamming to occur in the product package stack, when complete, during storage and transport. An additional advantage is that a single product package can easily be picked out of the product package stack. The above allows for a reliable machine filling process of the product packages, reducing both the number of fault situations in the filling process and the process lead time.

The double faces of the bottom and the rim portion allow inexpensive and environmentally friendly printing to be used for brand identification and product information displaying.

BRIEF DESCRIPTION OF DRAWINGS

In the following, the invention will be explained in more detail, by means of two exemplifying embodiments, with reference to the accompanying drawings wherein.

DETAILED DESCRIPTION OF INVENTION

Figure 1:
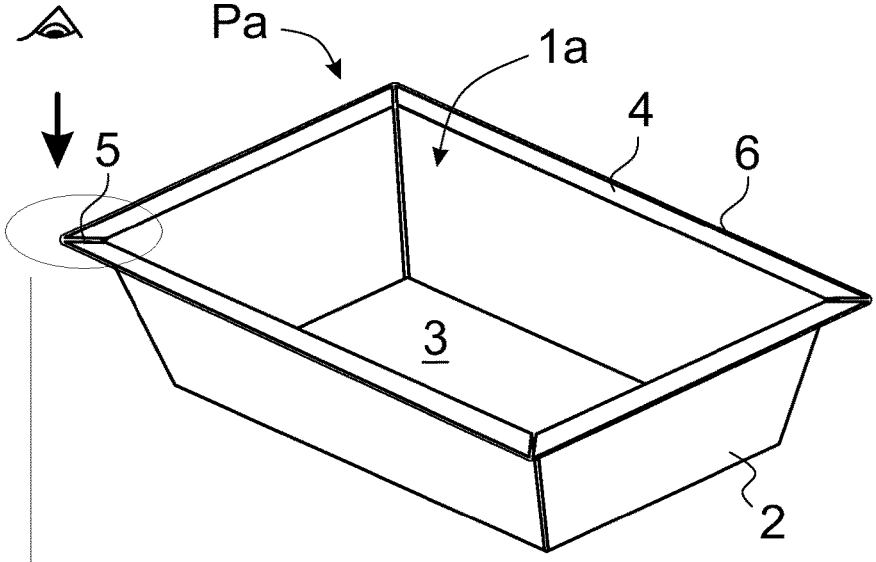
Fig. 1 Prior art
FIG. 1 is an oblique lateral and top view of a prior-art product package.
Figure 1A:
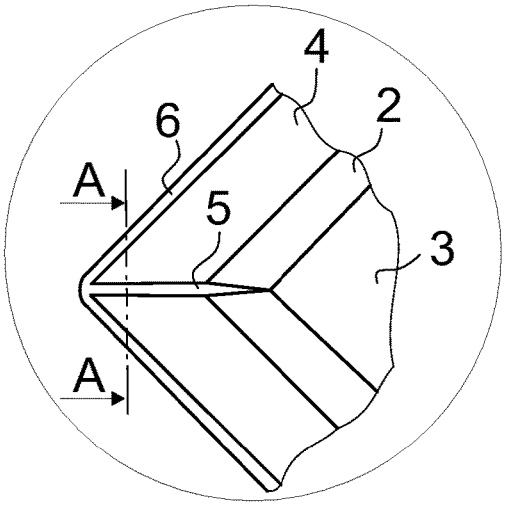
FIG. 1*a* is a simplified, not-to-scale top view of a discontinuous corner of the prior-art product package of FIG. 1.
Figure 1B:
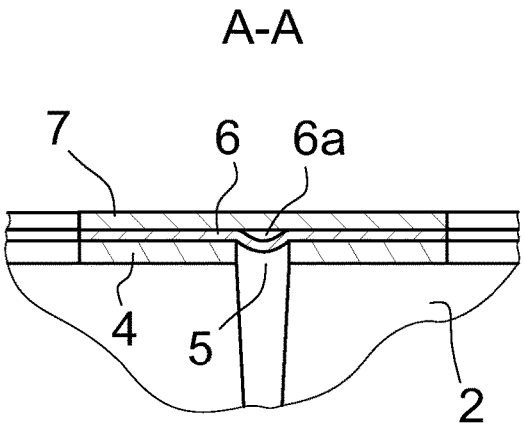
FIG. 1*b* is a simplified, not-to-scale, partially sectional lateral view of the discontinuous corner and an untight lid connecting solution of the prior-art product package of FIG. 1.

FIGS. 1, 1*a* and 1*b* show a product package according to the invention, Pa (Prior Art: EP 2441696 A1). For illustrative purposes, some of the figures exaggerate the thickness of the manufacturing material and of the films.

FIG. 1 is an oblique lateral and top view of a prior-art product package Pa. The product package Pa is folded out of a single cardboard blank. The product package Pa consists of a body part 2 and an inner lining 6. Correspondingly, the body part 2 consists of a bottom 3, two lateral walls and two end walls as well as of a substantially planar rim portion 4 extending laterally outwards from the upper edge of the lateral and end walls. The body part 2 is made of a suitable recyclable fiber material, such as cardboard. The product package Pa maintains its intended shape by means of thin foodstuff plastic used as the inner lining 6 and laminated to the body part 2, resulting in a weak and unstable structure due, for example, to the fact that the rim portion of the top is not seamless and continuous.

FIG. 1*a* is simplified and not-to-scale top view of a discontinuous corner of the product package Pa of FIG. 1. The above-mentioned structure solely supported by the inner lining causes that, in the assembling step of the product package Pa, where the inner lining 6 is attached to the body part 2 and to the planar rim portion 4, small slots are left in the corner seams 5 of the planar rim portion 4, making the planar rim portion 4 discontinuous.

FIG. 1*b* is a simplified, partially sectional and not-to-scale lateral view of the discontinuous corner and an untight lid connecting solution of the product package Pa of FIG. 1. As there is a slot in the corner seam 5 of the planar rim portion 4 of the product package Pa, the foodstuff plastic attached over the planar rim portion 4 and used for the inner lining 6 tends to deform towards the slot, leaving, in the surface of the planar rim portion, a groove 6*a* parallel to the corner seam 5. Later, the product package Pa will be filled with a foodstuff product and a covering film 7 will be sealed to the portion of the inner lining 6 attached over the planar rim portion 4 of the product package Pa by heat-sealing, for example. The above-mentioned grooves 6*a* of the inner lining 6, formed at the corner seams 5, leave an air channel between the inner lining 6 and the covering film 7, and thus, also in the receiving space 1*a* of the product package 1, making the product package non-airtight or possibly even non-watertight. Product packages having this structure do not allow a packaging gas, for example, to be used for enhancing the shelf-life of the food product, and are not suited as skin-packages.

Figure 2A:
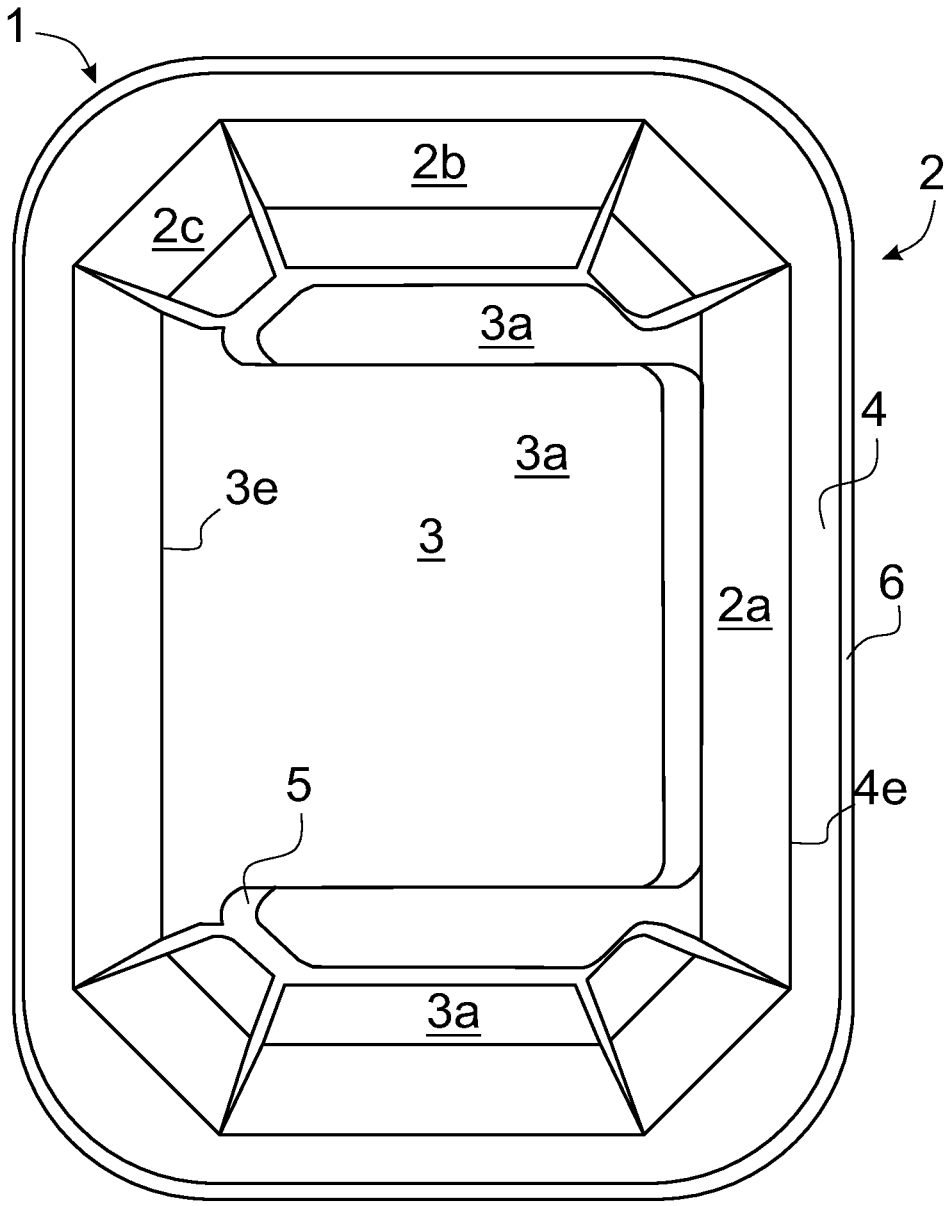
FIG. 2*a* is a direct top view of a product package according to the invention.
Figure 2B:
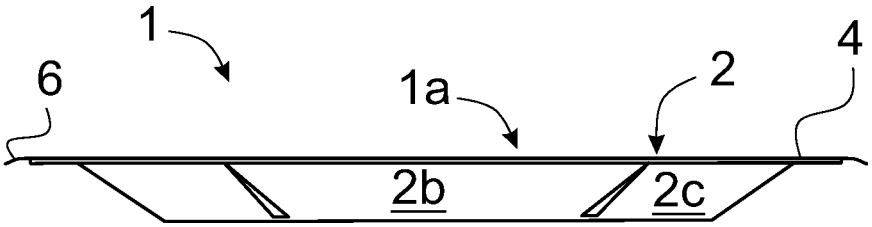
FIG. 2*b* is a not-to-scale lateral view of a side wall of the product package of FIG. 2*a*, after putting into shape.
Figure 2C:
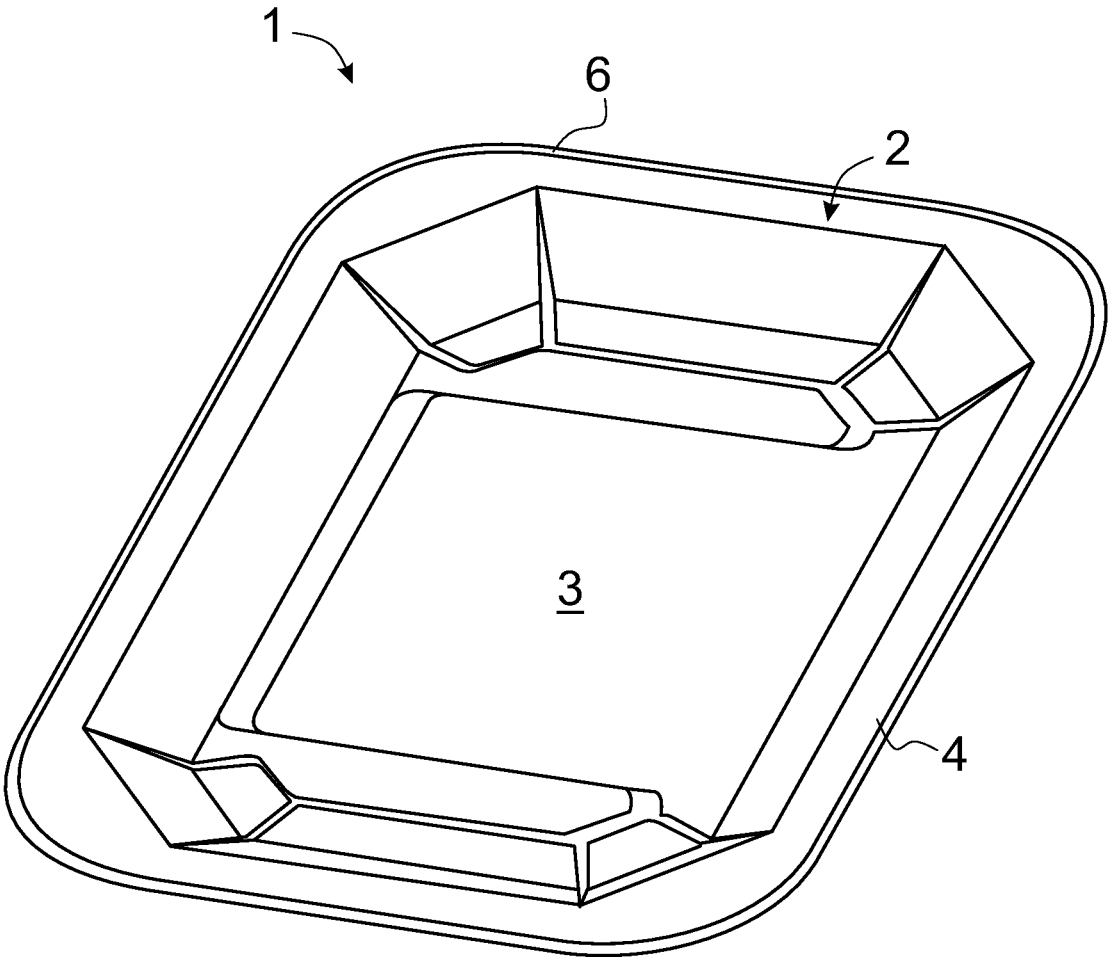
FIG. 2*c* is an oblique, not-to-scale lateral and top view of the product package of FIGS. 2*a* and 2*b*, after putting into shape.
Figure 2D:
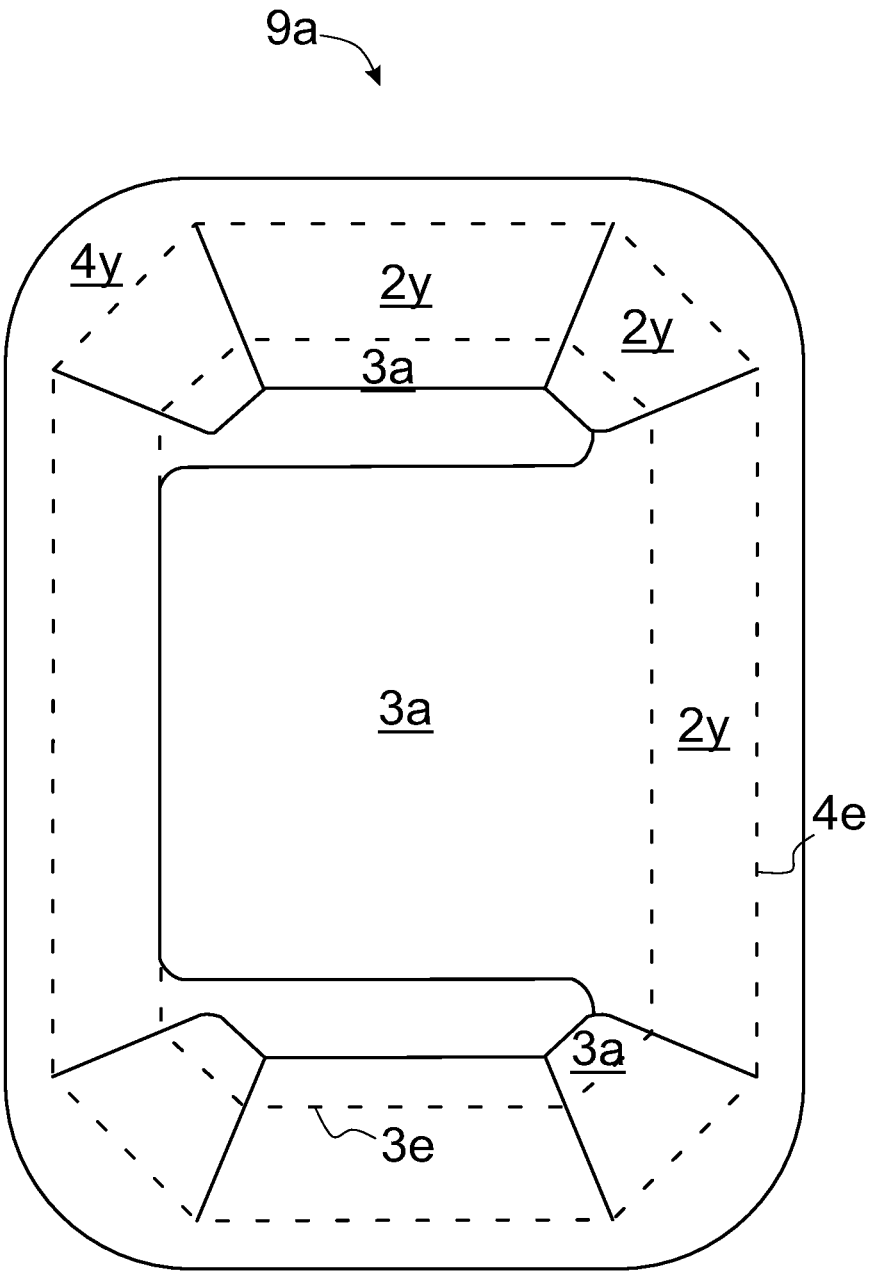
FIG. 2*d* is a direct top view of a package blank for the product package of FIG. 2.

FIGS. 2*a*, 2*b* and 2*c* show a product package 1 according to the invention. FIG. 2*d* show a package blank 9*a* for forming the body part 2 of the product package of FIGS. 2*a*, 2*b* and 2*c*.

FIG. 2*a* is a direct top view of a product package 1 according to the invention. Preferably, the product package 1 according to the invention is a foodstuff package intended for cold cuts for example. The empty product package 1 consists of a body part 2 and an inner lining 6, such as a foodstuff foil. Correspondingly, the body part 2 consists of nine bottom portions 3*a*, two lateral walls 2*a* and two end walls 2*b*, as well as of intermediate walls 2*c* extending therebetween, in the corners of the product package 1, and, additionally, of a continuous seamless rim portion 4 extending laterally outwards from the upper edge of the lateral, intermediate and end walls 2*a*, 2*b* and forming a substantially planar rim portion 4 of the product package 1. The bottom portions 3*a* form a bottom 3.

The body part 2 is made of a suitable recyclable fiber material. Preferably, the material is corrugated paperboard, cardboard or any other appropriate recyclable fiber material, for example. The inner lining 6 consists of foodstuff plastic and is, after use, easily separable from the body part 2, allowing the body part 2 and the inner lining 6 to be sorted for recycling. The body part 2 is manufactured by shaping and folding it out of a package blank 9*a*, by a machine, for example.

The continuous and seamless planar rim portion 4 of the body part 2 of product package 1 is a part, a common component, holding the walls (2*a*, 2*b*, 2*c*) together and making the structure sturdy. The lateral walls 2*a*, end walls 2*b* and intermediate walls 2*c*, which are folded at folding lines (4*e*) and from which the bottom portions 3*a* are created by folding along folding lines 3*e*, are connected to the rim portion (4).

The lateral walls 2*a*, end walls 2*b* and intermediate walls 2*c*, together with the bottom portions 3*a*, form a space for the product to be packaged, as the package blank 9*a* is folded, along the folding lines 4*e* and 3*e*, into a frame of the receiving space 1*a* for a food portion. The discontinuous structure of the frame of the receiving space 1*a*, also comprising a plurality of slots 5, results in savings in material costs because the body structure 2 involves neither sections with superimposed material nor material loss due to cutting, and, in addition, the plurality of slots 5 increase the volume of the receiving space 1*a*. The frame of the receiving space 1*a* provided with the inner lining 6 constitutes the actual sturdy receiving space 1*a* which reliably maintains its shape and tightness, also thanks to the inner lining 6.

The manufacturing method provides a continuous and even as well as seamless planar rim portion 4 for the product package 1, allowing the covering film 7 to be attached to the product package in an airtight manner. In skin-packages, air is sucked out of the package and the airtightness of the package ensures that a vacuum is maintained in the package 1.

FIG. 2*b* is a simplified and not-to-scale lateral view of one of the ends of the product package 1 of FIG. 2*a*, showing an end wall 2*b* and two intermediate walls 2*c* as well as a rim portion 4 and an inner lining 6 extending, on each side of the rim portion 4, beyond the rim portion 4.

The inner lining 6 is attached over the frame and the planar rim portion 4 of the receiving space 1*a* of the product package 1 by a machine, after folding and assembling it into shape. The inner lining 6 attaches to the body part 2 and is adapted to make the package airtight, together with the covering film 7. The inner lining 6 is attached, for example, by causing an under-pressure under the body part 2. The inner lining 6, having glue on its lower face, is adapted to be sucked, by the under-pressure, tightly against the inner face of the body part 2. This is done by sucking air, by means of the under-pressure, from between the body part 2 and the inner lining 6 located inside it, through the body part 2 and the apertures 5. The over-pressure prevailing above the package contributes to the attachment. The above-described method results in a tight attachment of the inner lining 6 to the inner face of the frame of the receiving space 1*a* of the body part 2 and over the rim portion 4. In addition, the inner lining 6 extends beyond the rim portion 4, allowing the body part 2 and the inner lining 6 to be easily separated from package, after it has been used, for sorted recycling.

At the rim portion 4, the inner lining 6 is evenly set, not allowing the inner lining 6 to form any grooves or projections which are detrimental to the tightness of the product package 1. Later, the product package 1 will be filled with a foodstuff product and the covering film 7 will be sealed to the portion of the inner lining 6 attached over the continuous seamless planar rim portion 4 of the product package 1. The covering film 7 of the product package 1 is adapted to be sealed to the inner lining 6 by heat-sealing, for example, or by some other suitable sealing method. At the above-mentioned seamless planar rim portion 4, the covering film 7 is tightly set against the inner lining 6 to make sure that the receiving space 1*a* of the product package 1 is watertight and airtight. This tightness ensures that the product package 1 according to the invention maintains a vacuum in skin-package applications, for example, or that a packaging gas, for example, can be used in the product package 1 to enhance the shelf-life of the foodstuff product.

FIG. 2*d* is a top view of a preferable package blank 9*a* according to the invention before shaping it into the product package 1. Appropriate cuts and folding lines 3*e* and 4*e* are made in the product blank 9*a*, at folding points, to facilitate machine-folding of the package blank 9*a* into the product package 1. The folding lines 3*e* and 4*e* are made by creasing, for example.

Preferably, the product blank 9*a* comprises a sheet-like structure made of recyclable fiber material and having bottom portions 3*a*, wall portions 2*y* and a rim portion 4*y*, separated by the folding lines 3*e* and 4*e*, for a bottom 3, walls 2*a*, 2*b*, 2*c* and a rim portion 4 of the product package 1 to be created out of the product blank by folding. In a preferred solution, the bottom portions 3*a* are separated, along the folding lines 3*e*, from the wall portions 2*y* forming the walls (2*a*, 2*b*, 2*c*).

Figure 3A:
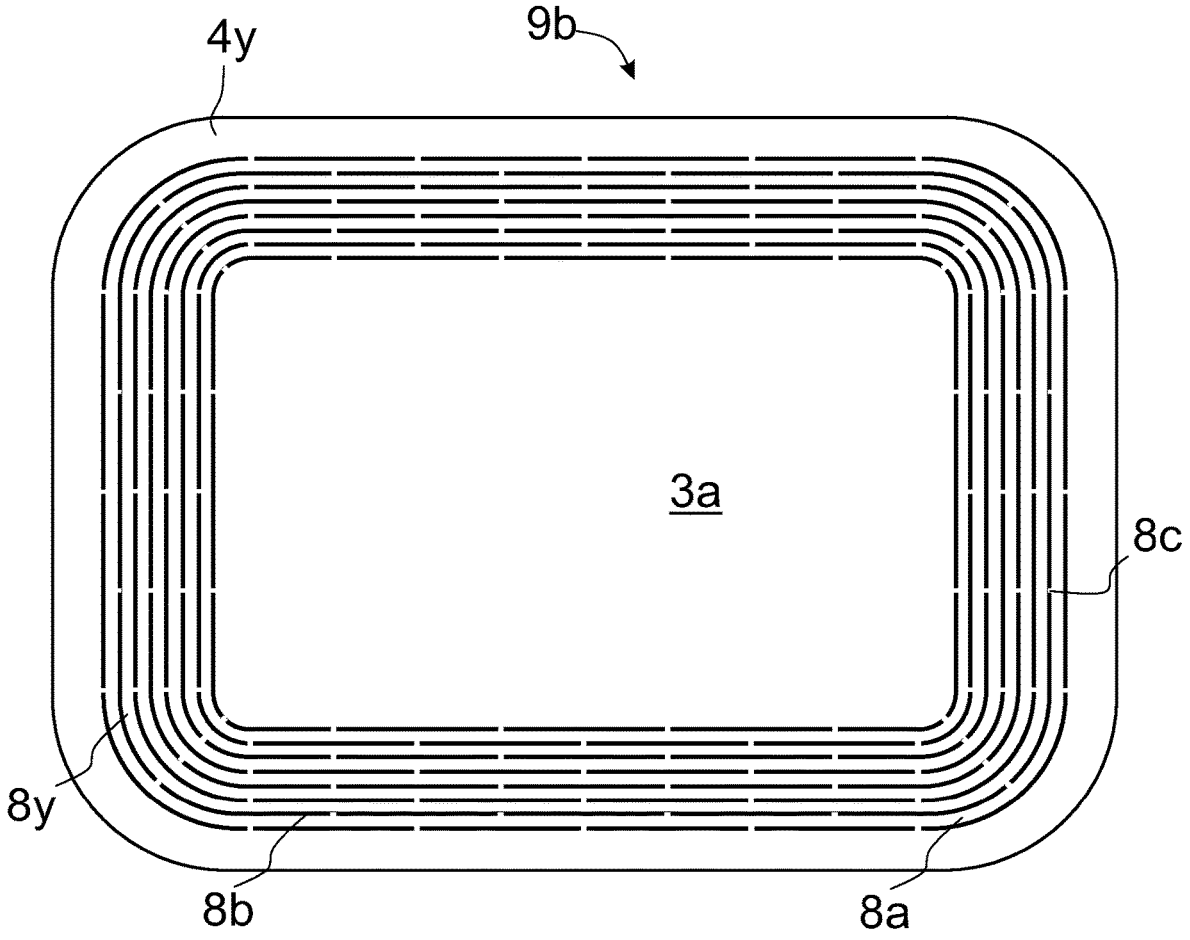
FIG. 3*a* is a direct top view of another package blank according to the invention, before forming it into a product package.

FIG. 3*a* is a top view of another flat package blank 9*b* according to the invention before putting it into the shape of the product package 1. This package blank 9*b* has a planar and seamless rim portion 4*y* and a planar continuous bottom portion 3*a*. A wall portion 8*y*, consisting of continuous circumferential portions 8*a* inside each other, is located between the bottom portion 3*a* and the rim portion 4*y*. The circumferential portions 8*a* are separated from each other by systematically alternating circumferential cut seams 8*b* and bridges 8*c*. The rim portion 4*y* and the bottom portion 3*a* are similarly separated from the circumferential portions 8*a*. Thus, the circumferential portions 8*a* are connected to the adjacent circumferential portions 8*a* by the bridges 8*c*, this configuration allowing a flexible basket-shaped structure and a receiving space 1*a* to be later created for the product to be packaged.

Figure 3B:
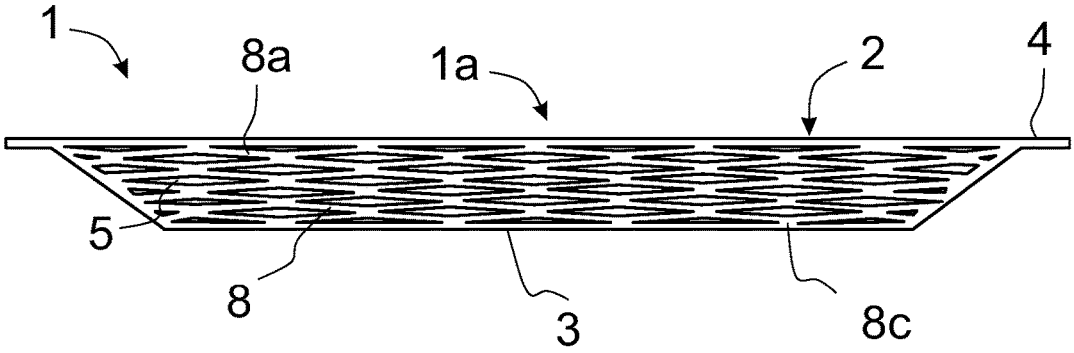
FIG. 3*b* is a not-to-scale lateral view of a side wall of the product package of FIG. 3*a*, after putting into shape.

FIG. 3*b* is a lateral view of the body part 2 of the product package 1 created out of the product blank 9*b* of FIG. 3*a*, after putting into shape. The body part 2 has a bottom 3, a rim portion 4 and a wall 8. The wall 8 comprises continuous circumferential portions 8*a*, bridges 8*c* interconnecting the circumferential portions 8*a*, and a plurality of slots 5 formed by the cut seams 8*b*. Once put into shape, the product package 1 forms a frame for the receiving space 1*a* since the circumferential portions 8*a*, cut seams 8*b* and bridges 8*c* of the wall 8, as a result of the systematic alternation, form a basket-shaped structure. When an inner lining 6 is laid on the basket-shaped body part 2 created in this way, the product package 1 becomes rigid in construction and the receiving space 1 for the product to be packaged is formed.

Figure 4:
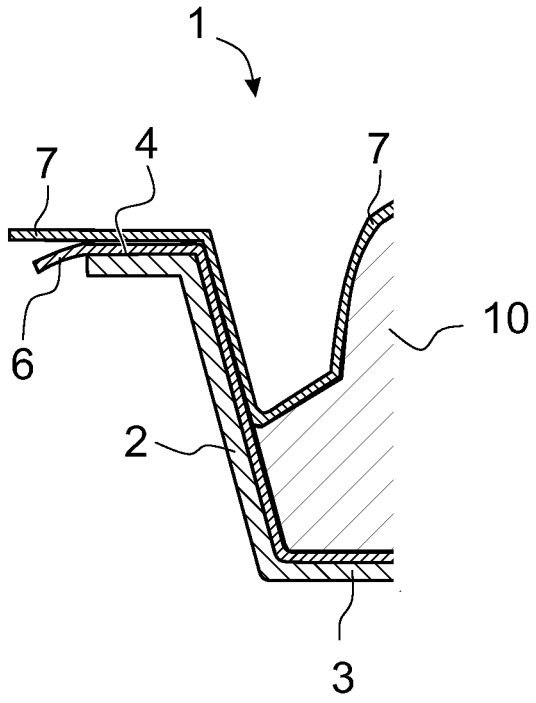
FIG. 4 is a sectional, simplified and not-to-scale lateral view of a portion of a product package according to the invention, provided with a skin-film.

FIG. 4 is a sectional, simplified and not-to-scale lateral view of a product package 1 according to the invention, provided with a covering film 7. The figure illustrates how the receiving space 1*a* and the rim portion 4 of the product package 1 are covered by an inner lining 6 and how the product package 1 containing a ready foodstuff product 10 is closed, at the even and planar rim portion 4, by the covering film 7 attached to the inner lining 6. The portions of the covering film 7 and the inner lining 6 extending outside the rim portion 4 of the skin product package of FIG. 4 are not attached to each other, allowing the product package 1 to be effortlessly opened. After use, the inner lining 6 is easily separable from the body part 2, by pulling at the portion of the inner lining 6 located outside the rim portion 4.

Figure 5K:
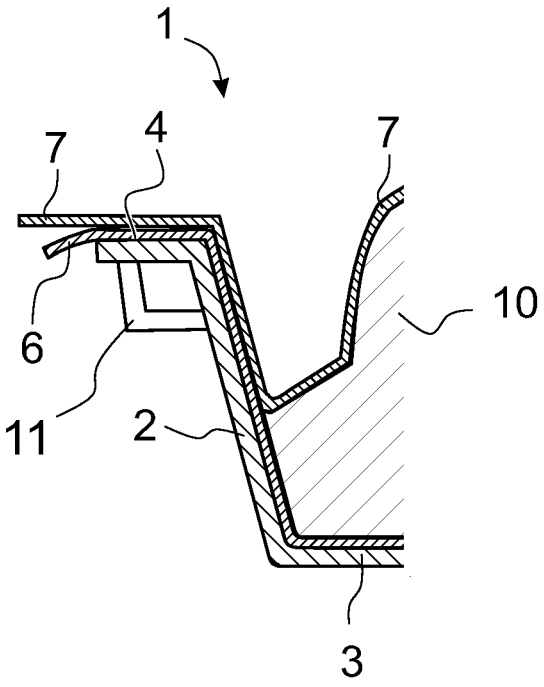
FIG. 5*k* is a sectional, simplified and not-to-scale lateral view of the product package of FIG. 4, provided with a bracket member.

FIG. 5*k* is a sectional, simplified and not-to-scale lateral view of the product package of FIG. 4, provided with a bracket member 11. At the bracket member 11, the fold between the rim portion 4 and the intermediate wall 2*c* bends in a different direction outside the bracket member 11.

Figure 6K:
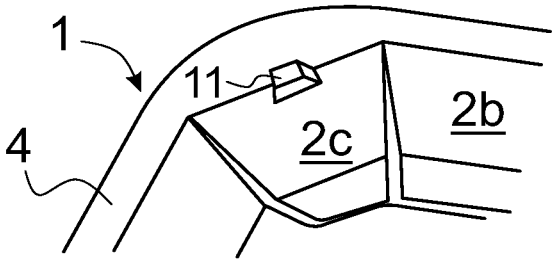
FIG. 6*k* is an oblique lateral and top view of the product package of FIG. 5*k*.

FIG. 6*k* is an oblique lateral and top view of a corner of the product package 1 where the bracket member 11 is pushed out into shape.

Figure 7K:
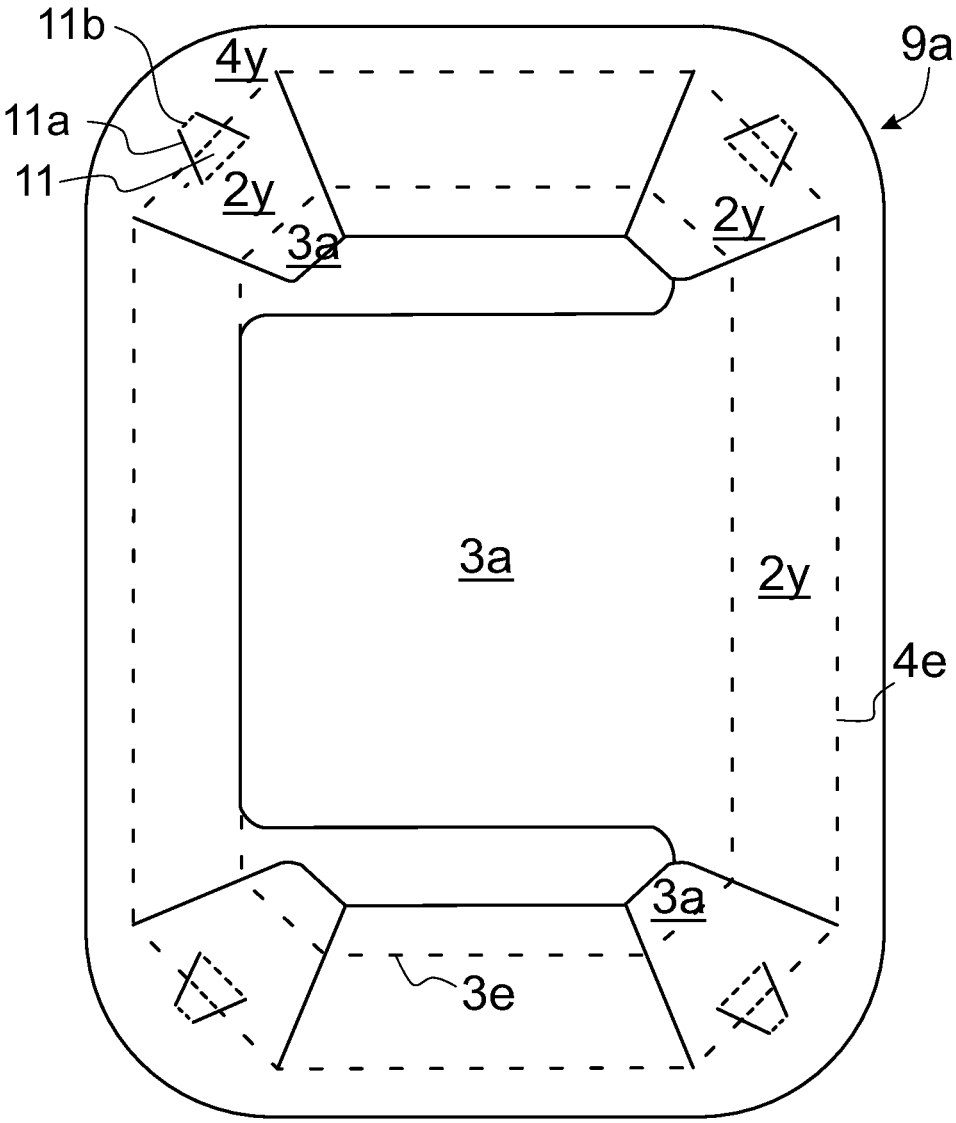
FIG. 7*k* is a direct top view of a package blank for the product package of FIG. 5*k*.

FIG. 7*k* is a direct top view of a package blank 9*a* for the product package 1, having cuts 11*a* and creases 11*b* made between the wall portions 2*y* and the rim portion 4*y* for the purpose of forming the bracket member 11. However, the figure does not show how the horizontal part of the bracket member 11 is substantially wider than the vertical part thereof.

Preferably, a vast potential information-displaying surface, such as a pressing or printing surface, is formed on the product package 1, on both faces of the bottom and the rim portion, and, in certain applications, also on the faces of the wall portions. The displaying surfaces provided on both sides allow pressing/printing to be used, inter alia, for brand identification and product information displaying.

It will be appreciated by a person skilled in the art that the invention is not solely restricted to examples above but may vary within the scope of the accompanying claims. Thus, some structural solutions may differ from the above.

It will also be appreciated by the person skilled in the art that the product packages may differ in shape from the above. The simplest and most common shape of the body part of the product package is a rectangle, for example. However, the package can have some other than a box-like rectangular shape. As an example, this shape can be polygonal, or also round or oval, depending on the folding lines of the finished blank. When the shape is not a quadrilateral, the number of the walls may also differ from the above, and, therefore, separate lateral or end walls may not exist. It is also possible to make the angle between the bottom and the walls, for example, less acute by an additional fold of the walls, near the bottom. Further, the shape can also be asymmetrical.

It will also be appreciated by the person skilled in the art that the product packages may consist of some other material than recyclable fiber material. In this case, the body part of the product package can be made of any other foldable material, such as corrugated paperboard. The body part of the product package can be made of different grades of board, cardboard or paper, or, also of woven material, or of combinations of different materials.

The invention claimed is:

1. A product package comprising a receiving space, a covering film, an inner lining, and a body part created by folding out of a single blank, the body part comprising walls, a bottom and a rim portion as well as a plurality of slots for shaping the receiving space, wherein the rim portion of the body part is created out of the single blank without superimposing, outer edges of the single blank constitute outer edges of the rim portion of the body part, wherein the rim portion of the body part is continuous, seamless and planar, interconnecting the walls of the body part.

2. A product package of claim 1, wherein the inner lining covers the receiving space and the rim portion of the product package.

3. A product package of claim 1, wherein a portion of, or all of, the inner lining extends beyond the outer edges of the rim portion, the inner lining being separable from the body part, in its entirety, by detaching it at this portion of the inner lining.

4. A product package of claim 1, wherein the covering film of the product package covers a packaged product and is sealed to the inner lining, at least over the rim portion.

5. A product package of claim 1, wherein the body part of the product package is shaped out of a package blank, and in that the package blank comprises cuts by means of which a three-dimensional structure of the body part is adapted to be formed.

6. A product package of claim 1, wherein the body part is made of recyclable fiber material, and the material is corrugated paperboard, cardboard or some other suitable recyclable fiber material.

7. A product package of claim 1, wherein the body part of the product package comprises one or more continuous surfaces for displaying information.

8. A product package of claim 1, wherein the walls and the bottom of the body part of the product package comprise a plurality of slots, the walls, the bottom and the plurality of slots forming the receiving space, together with the inner lining.

9. A product package of claim 8, wherein the wall portion of the body part is formed, with circumferential portions nested inside each other and with bridges therebetween, into a basket-shaped wall portion comprising a plurality of slots and forming the receiving space, together with the bottom and the inner lining.

10. A product package of claim 1, wherein the body part of the product package comprises more than one bracket member to keep product packages, when nested, spaced apart.

11. A product package of claim 1, wherein the rim portion of the body part has a thickness that is the same as a thickness of the single blank.

12. A single product package blank made of recyclable fiber material and having a bottom portion, a wall portion and a rim portion for a bottom, walls and a rim portion of a product package to be created by folding out of the single product package blank, wherein the rim portion of the single product package blank comprises outer edges which constitute outer edges of the rim portion of the product package, wherein the rim portion of the single product package blank is adapted to act as the rim portion of the product package without superimposing, which is continuous, seamless and planar.

* * * * *